US009567702B2

(12) United States Patent
Seo et al.

(10) Patent No.: US 9,567,702 B2
(45) Date of Patent: Feb. 14, 2017

(54) WASHING MACHINE

(71) Applicant: LG ELECTRONICS INC., Seoul (KR)

(72) Inventors: Bosung Seo, Seoul (KR); Sooyoung Oh, Seoul (KR); Changoh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/817,456

(22) Filed: Aug. 4, 2015

(65) Prior Publication Data

US 2016/0040347 A1 Feb. 11, 2016

(30) Foreign Application Priority Data

Aug. 5, 2014 (KR) ..... 10-2014-0100620

(51) Int. Cl.
*D06F 39/08* (2006.01)
*D06F 39/00* (2006.01)

(52) U.S. Cl.
CPC ..... *D06F 39/004* (2013.01); *D06F 39/081* (2013.01); *D06F 39/083* (2013.01); *D06F 39/086* (2013.01)

(58) Field of Classification Search
CPC .... D06F 39/004; D06F 33/02; A47L 15/4297; A47L 2401/10; A47L 2501/30
USPC ..... 68/12.02, 12.27, 12.19, 13 R, 12.01, 58; 8/137, 158, 159; 134/18, 56 D, 113, 34, 134/58 R, 104.2; 137/561 A, 119.01, 2, 387, 846, 137/93
See application file for complete search history.

(56) References Cited

U.S. PATENT DOCUMENTS

| | | | | |
|---|---|---|---|---|
| 3,691,797 | A * | 9/1972 | Smith | D06F 39/086 68/23.4 |
| 5,048,139 | A * | 9/1991 | Matsumi | D06F 39/004 68/12.02 |
| 5,881,578 | A * | 3/1999 | Proppe | D06F 39/004 68/12.02 |
| 2004/0007029 | A1* | 1/2004 | Bolduan | D06F 39/004 68/12.02 |
| 2008/0244836 | A1* | 10/2008 | Kim | D06F 33/02 8/159 |

FOREIGN PATENT DOCUMENTS

| | | | |
|---|---|---|---|
| EP | 0 849 390 | A2 | 6/1998 |
| JP | 05154278 | A * | 6/1993 |
| JP | H 05-154278 | A | 6/1993 |
| WO | WO 02/46514 | A2 | 6/2002 |

OTHER PUBLICATIONS

Takahaski, Taketo, "Turdbidity Detecting Device for Washing Machine" JP 5-154278 Machine Translation.*
European Search Report dated Dec. 1, 2015 issued in Application No. 151795192.2.

* cited by examiner

*Primary Examiner* — David Cormier
*Assistant Examiner* — Thomas Bucci
(74) *Attorney, Agent, or Firm* — KED & Associates, LLP

(57) ABSTRACT

A washing machine includes a tub for containing washing water, a drum rotatably disposed in the tub, a chamber communicating with the tub through a plurality of openings in which washing water is introduced from the tub through at least one of the plurality of openings and the introduced washing water is discharged to the tub through at least one of the remaining openings, and a water quality detector for detecting the quality of washing water in the chamber.

19 Claims, 7 Drawing Sheets

WASHING MACHINE

CROSS-REFERENCE TO RELATED APPLICATION

This application claims priority under 35 U.S.C. §119 to Korean Patent Application No. 10-2014-0100620, filed on Aug. 5, 2014 in the Korean Intellectual Property Office, whose entire disclosure is incorporated herein by reference.

BACKGROUND OF THE INVENTION

1. Field of the Invention

The present invention relates to a washing machine.

2. Description of the Related Art

Generally, a washing machine is an apparatus for removing pollutants from laundry, such as clothing, by the emulsification of water and detergent. The washing machine includes a tub for containing washing water and a drum rotatably disposed in the tub to contain laundry. Such washing machines may be classified into a front-loading type, in which a drum, into which clothes are introduced from front, rotates about the horizontal axis, and a top-loading type, in which a drum, into which clothes are introduced from above, rotates about the vertical axis.

The washing machine is provided with a turbidity sensor for detecting the turbidity of washing water introduced into the tub. Water streams are created in the tub due to the rotation of the drum. Since a conventional washing machine includes a turbidity sensor positioned at the bottom of the tub, variation in the value measured by the turbidity sensor is caused by sloshing of washing water, and measurement accuracy is further deteriorated owing to various causes, such as bubbling caused by detergent, turbulence caused by extraneous substances in washing water, and the like.

SUMMARY OF THE INVENTION

Therefore, the present invention has been made in view of the above problems, and it is an object of the present invention to provide a washing machine including a water quality detector, which is improved in measurement accuracy.

Another object of the present invention is to provide a washing machine in which a space required for washing and a space required for detection of water quality are isolated from each other.

A further object of the present invention is to provide a washing machine which minimizes the influence of sloshing and bubbling of washing water, occurring during a washing operation, on measurement accuracy of a water quality detector.

In accordance with an aspect of the present invention, the above and other objects can be accomplished by the provision of a washing machine including a tub for containing washing water, a drum rotatably disposed in the tub, a chamber communicating with the tub through a plurality of openings in which washing water is introduced from the tub through at least one of the plurality of openings and the introduced washing water is discharged to the tub through at least one of the remaining openings, and a detector for detecting the quality of the washing water in the chamber.

The plurality of openings may be arranged vertically.

The plurality of openings may be arranged horizontally.

At least one of the plurality of openings may be positioned below the bottom surface of the tub.

The plurality of openings may be arranged vertically and horizontally toward the lowermost opening from the uppermost opening.

The plurality of openings may be arranged such that the closer the opening is to a vertical center line of the drum, the lower it is positioned.

The water quality detector may be positioned to be lower than any of the plurality of openings.

The washing machine may further include a pump for discharging washing water in the tub, wherein the chamber may include a drain outlet communicating with the pump.

The drain outlet may be positioned to be lower than the detector.

The washing machine may further include a check valve, which closes the drain outlet upon deactivation of the pump and opens the drain outlet upon activation of the pump.

The check valve may include an inlet, through which washing water is introduced from the chamber, and an outlet, through which the washing water introduced through the inlet is discharged and which is expanded by hydraulic pressure upon activation of the pump.

The check valve may be made of a flexible material having elasticity.

The check valve may be partially cut at the periphery of the outlet.

The chamber may include first and second chamber housings, which are combined with each other to define a space for receiving washing water, in which the first chamber housing is provided with the plurality of openings and the second chamber housing is provided with an installation member for installation of the detector.

The detector may include a turbidity sensor.

The detector may include an electrode sensor.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

The advantages, features and methods for achieving those in the embodiments may become apparent upon referring to the embodiments, described later in detail together with attached drawings. However, the embodiments are not limited to the embodiments disclosed hereinafter, but may be embodied in different modes. The embodiments are provided for completeness of disclosure and informing the scope to persons skilled in this field of art. The same reference numbers may refer to the same elements throughout the specification.

Figure 1:
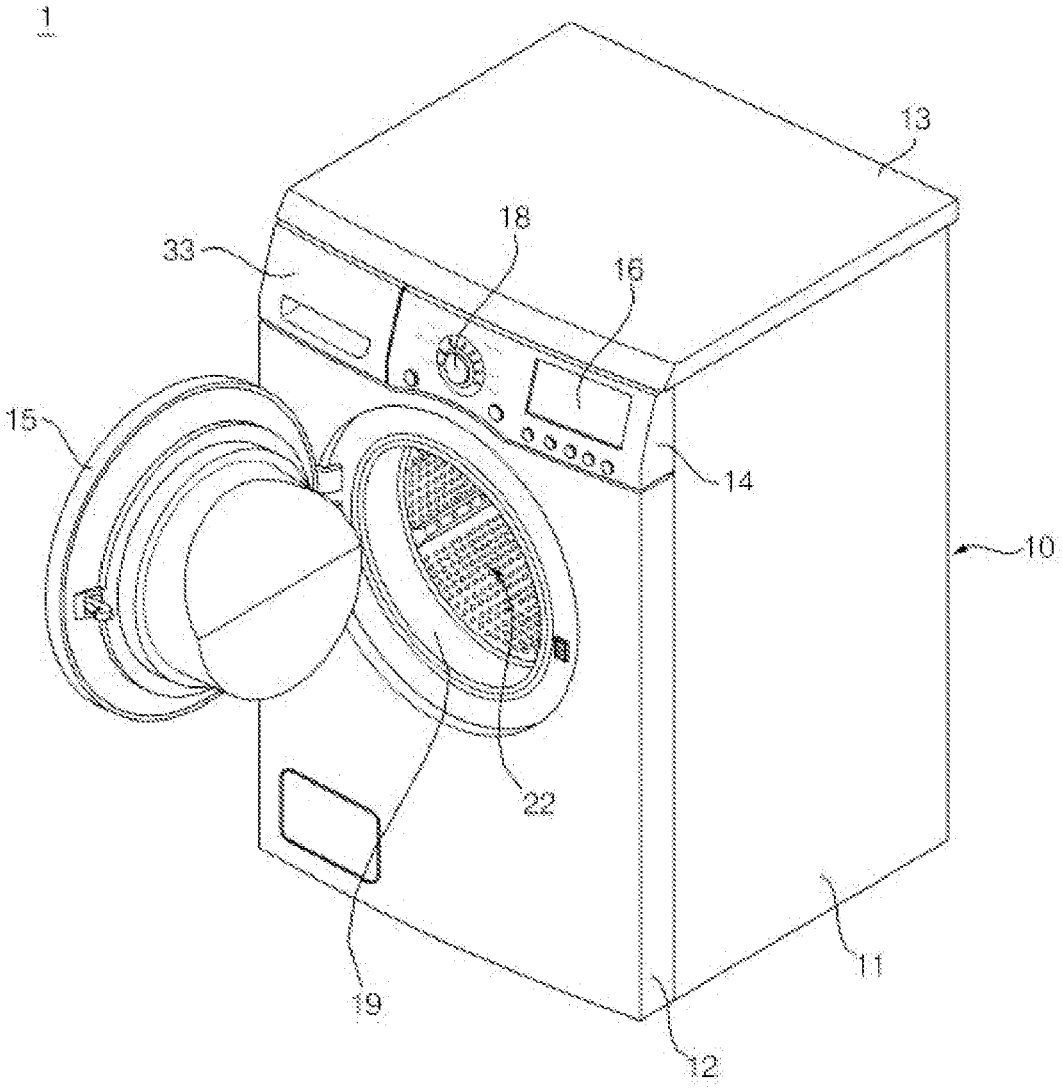
FIG. 1 is a perspective view showing a washing machine according to an embodiment of the present invention.
Figure 2:
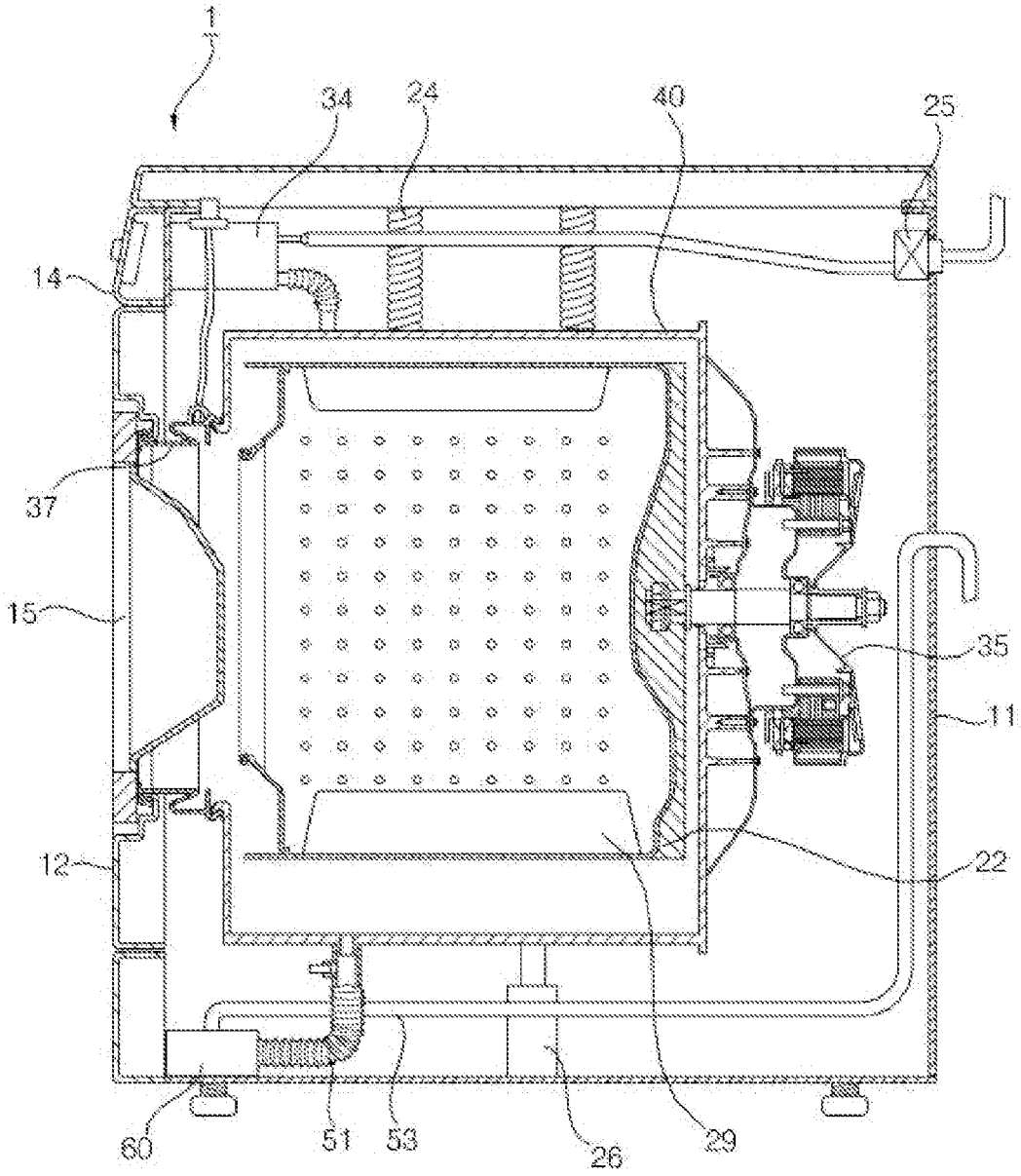
FIG. 2 is a cross-sectional view showing the internal constitution of the washing machine according to the embodiment of the present invention.
Figure 3:
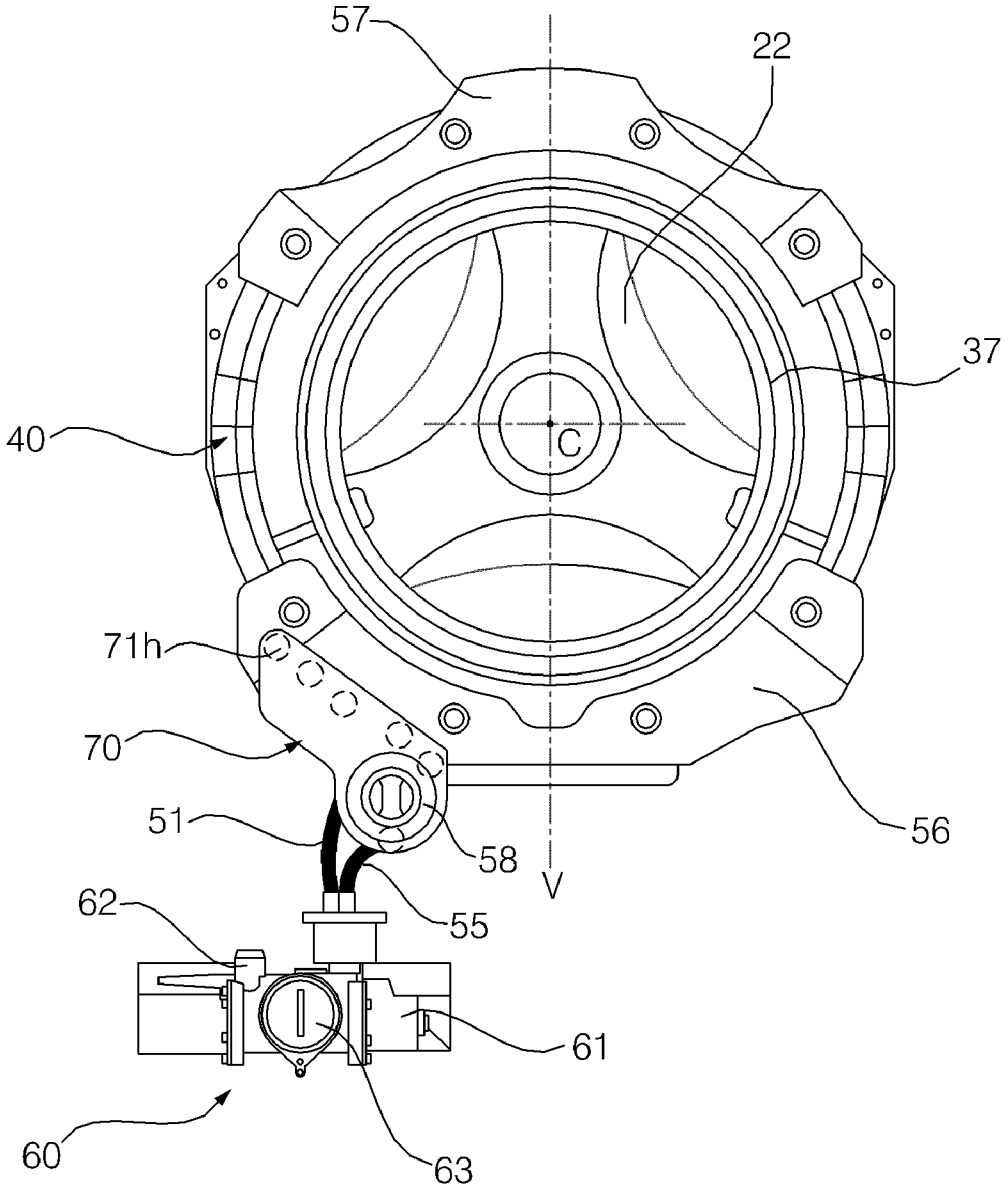
FIG. 3 is a view showing the washing machine according to the embodiment of the present invention, from which a casing is removed.
Figure 4:
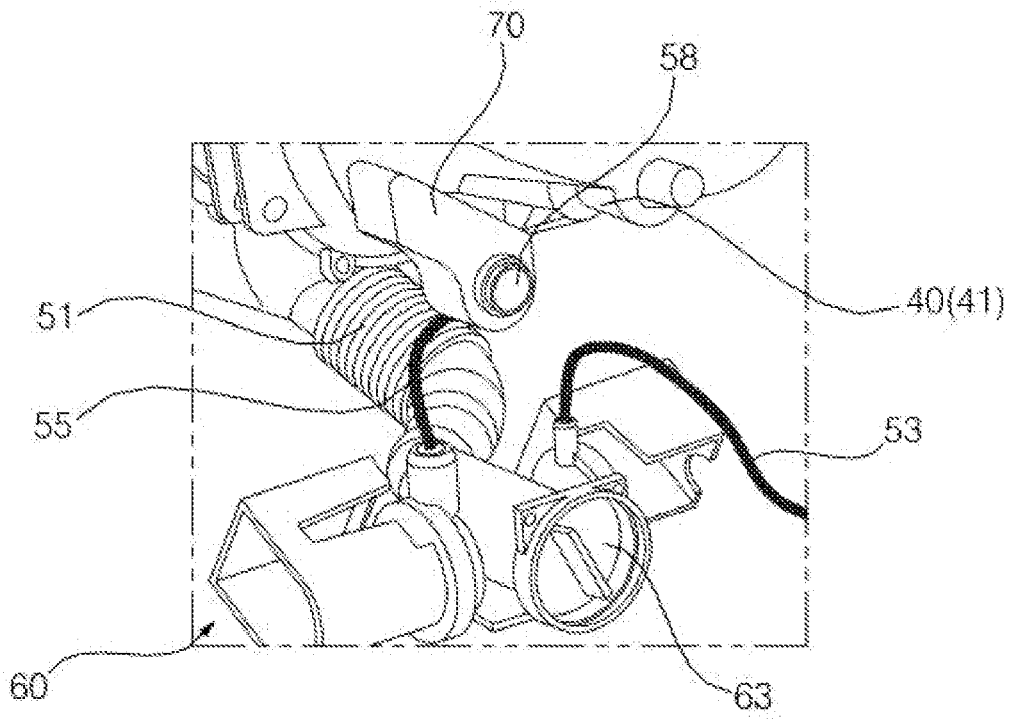
FIG. 4 is a view showing a flow channel connecting structure between a tub, a pump and a chamber.
Figure 5:
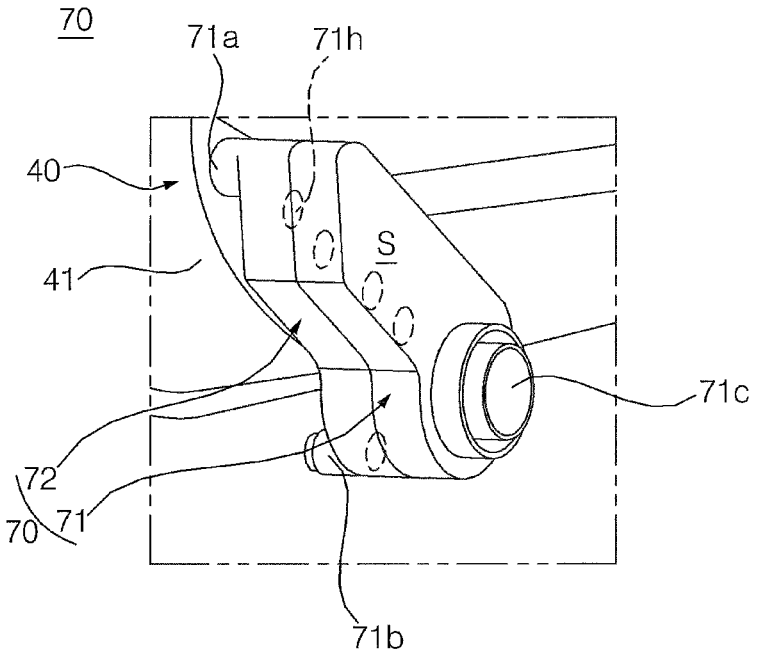
FIG. 5 is an enlarged view of the chamber coupled to the tub.
Figure 6:
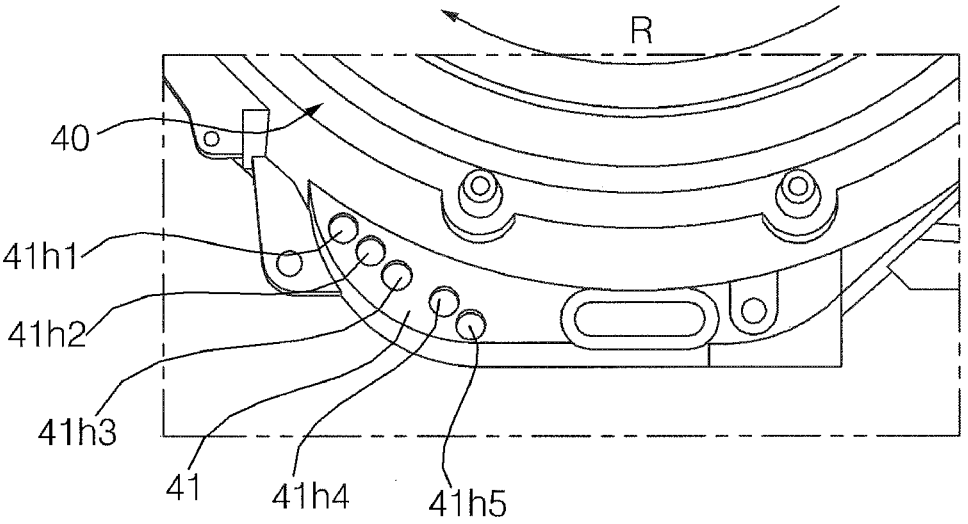
FIG. 6 is a view showing coupling holes formed in the tub for installation of the chamber.
Figure 7:
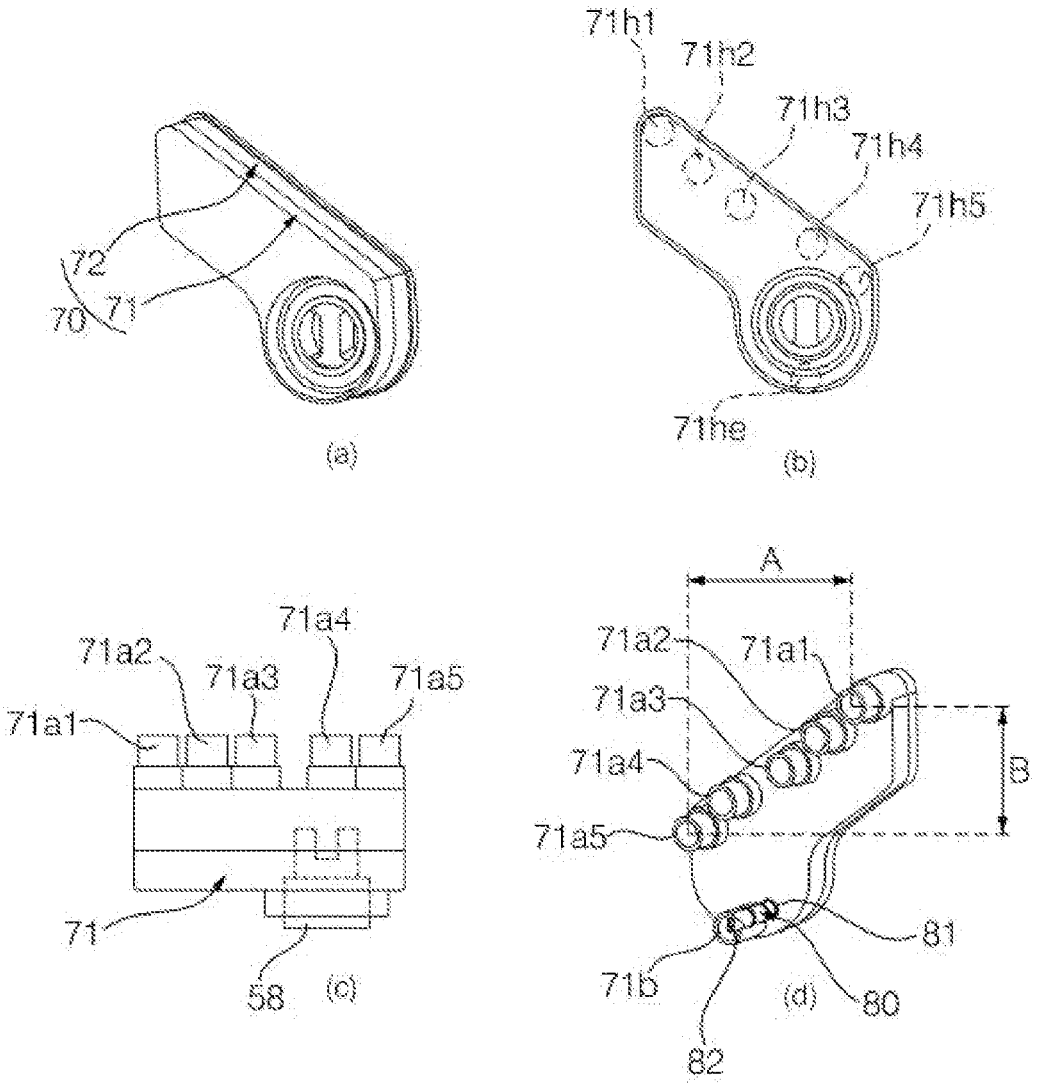
FIG. 7 is a view showing the assembly of the chamber and a turbidity sensor, in which (a) is a front perspective view, (b) is a projection view when viewed from the front, (c) is a projection view when viewed from above, and (d) is a rear perspective view.

FIG. 1 is a perspective view showing a washing machine according to an embodiment of the present invention. FIG. 2 is a cross-sectional view showing the internal constitution of the washing machine according to the embodiment of the present invention. FIG. 3 is a view showing the washing machine according to the embodiment of the present invention, from which a casing has been removed. FIG. 4 is a view showing a flow channel connecting structure between a tub, a pump and a chamber. FIG. 5 is an enlarged view of the chamber coupled to the tub. FIG. 6 is a view showing coupling holes formed in the tub for installation of the chamber. FIG. 7 is a view showing an assembly of the chamber and a turbidity sensor, in which (a) is a front perspective view, (b) is a projection view when viewed from the front, (c) is a projection view when viewed from above, and (d) is a rear perspective view.

Referring to FIGS. 1 to 7, the washing machine 1 according to the embodiment of the present invention may include a casing 10, a tub 40 disposed in the casing 10 to contain washing water, a drum 22 disposed in the tub 40 to contain laundry, a driving unit 35 for rotating the drum 22, a water supply valve 25 for interrupting or allowing water supply from an external water source, a tub discharge hose 51 for discharging washing water from the tub 40, and a pump 60.

The casing 10 may include a cabinet 11, defining the appearance of the washing machine 1 and opening at front and upper surfaces thereof, a front cover 12, coupled to the front surface of the cabinet 11 and having a laundry introduction port 19 for allowing laundry to be put into or taken out of the drum 22, a control panel 14, provided at an upper portion of the front cover 12, and a top cover 13, provided at the upper end of the cabinet 11.

The front cover 12 is provided with a door 15, which is hingedly coupled thereto to open or close the laundry introduction port 19. The control panel 14 includes a display unit 16 for displaying various information about the state of the washing machine 1, and an input unit 18 for enabling various control commands, such as operating times of respective modes and reserved operations, to be input therethrough.

A detergent box 33 contains laundry detergent, fabric softener, bleaching agent, or the like. The detergent box 33 may be provided at the front surface of the front cover 12 in a drawable manner. The detergent in the detergent box 33 is mixed with washing water at the time of supply of washing water, and is then introduced into the tub 40.

The tub 40 is suspended from the top cover 13 by springs 24, and is supported by a damper 26. Consequently, the vibrations of the tub 40 are absorbed by virtue of the springs 24 and the damper 26. The drum 22 may be rotated by the driving unit 35, and may be provided therein with lifters 29 for lifting laundry during rotation of the drum 22.

A gasket 37 is provided between the casing 10 and the tub 40. The gasket 37 is coupled at one side thereof to the casing 10, and is coupled at the other side thereof to the tub 40 along the periphery of the opening of the tub 40. Consequently, leakage between the tub 40 and the casing 10 of washing water contained in the tub is blocked. The gasket 37 is corrugated to absorb the vibrations of the tub 40.

The pump 60 is provided to discharge washing water discharged from the tub 40. The pump 60 serves to forcedly pump washing water, introduced from the tub discharge hose 51, to the water discharge hose 53 so as to discharge the washing water to the outside of the washing machine 1. The pump 60 may include a pump housing 62 into which washing water is introduced through the tub discharge hose 51, an impeller (not shown) disposed in the pump housing 62, a pump motor 61 for rotating the impeller, and a filter 63 detachably coupled to the pump housing 62 to collect extraneous substances contained in washing water.

The tub 40 may be provided with balance weights 56 and 57. The balance weights 56 and 57, which are considerably heavy in order to provide static inertia for attenuation of vibrations of the tub 40, may be provided at upper and lower positions on the front surface of the tub 40.

The washing machine 1 includes a chamber 70, having a plurality of communication openings that communicate with the tub 40 and defining a space S for receiving washing water introduced from the tub 40 through at least one of the plurality of communication openings, and a water quality detector 58 for detecting the quality of washing water contained in the chamber 70. The chamber 70 includes a plurality of tub connecting pipes **71*a*1, 71*a*2, 71*a*3, 71*a*4 and 71*a*5 connected to the tub 40. Each of the plurality of tub connecting pipes 71*a*1, 71*a*2, 71*a*3, 71*a*4 and 71*a*5 is provided with a respective communication opening 71*h*1, 71*h*2, 71*h*3, 71*h*4 and 71*h*5**.

Although the chamber may be provided with a single communication opening, smooth circulation of washing water between the tub 40 and the chamber 70 becomes difficult in this case. Accordingly, the chamber 70 is preferably provided with the plurality of communication openings such that a water stream from the tub 40 to the chamber 70 is created through at least one of the plurality of communication openings and a water stream from the chamber 70 to the tub 40 is created through at least one of the remaining communication openings. This structure enables smooth circulation of washing water between the tub 40 and the chamber 70, so that the water quality detected by the water quality detector 58 is considered as being representative of the quality of all of the water in the tub 40.

The circulation of washing water between the tub 40 and the chamber 70 is mainly caused by rotation of the drum 22. In other words, the circulation of washing water is predominantly caused by frictional force between the rotating drum 22 and washing water, pushing force caused by the lifters 29 provided at the drum 22, and the like. In this regard, in order to allow smooth circulation of washing water between the tub 40 and the chamber 70, the positions of the communication openings should be determined in consideration of the influences of the level of washing water contained in the tub 40 and the rotational direction of the drum 22 on the water stream.

The plurality of communication openings **71*h*1, 71*h*2, 71*h*3, 71*h*4 and 71*h*5 may be vertically arranged at different levels. Since the communication openings 71*h*1, 71*h*2, 71*h*3, 71*h*4 and 71*h*5 are provided at various levels, washing water can always be introduced into the chamber 70, regardless of the water level in the tub 40**.

The plurality of communication openings **71*h*1, 71*h*2, 71*h*3, 71*h*4 and 71*h*5 may be arranged horizontally. Since a horizontal flow component of washing water is predominant in a lower part of the tub 40 due to the rotation of the drum 22, one of the plurality of horizontally arranged communication openings 71*h*1, 71*h*2, 71*h*3, 71*h*4 and 71*h*5, which is positioned upstream of the water stream, serves as an inflow opening through which washing water is introduced into the chamber 70, and another of the plurality of communication openings 71*h*1, 71*h*2, 71*h*3, 71*h*4 and 71*h*5, which is positioned downstream of the water stream, in contrast to the communication opening serving as the inflow opening, serves as an outflow opening through which washing water is discharged from the chamber 70. Accordingly, the circulation of washing water between the chamber 70 and the tub 40 may be smoothly implemented while minimizing interference or turbulence by water stream created in the tub 40. For reference, "R" in FIG. 6 denotes the rotational direction of the drum 22. In this case, a water stream, which advances from the right side to the left side in FIG. 6, is created in the tub 40**.

In this embodiment, the plurality of communication openings 71*h*1, 71*h*2, 71*h*3, 71*h*4 and 71*h*5 are arranged both in a horizontal direction as well as in a vertical direction. The plurality of communication openings 71*h*1, 71*h*2, 71*h*3, 71*h*4 and 71*h*5 are arranged such that they vary in height toward one horizontal direction. This structure is shown in FIG. 3 and other figures. The plurality of communication openings 71*h*1, 71*h*2, 71*h*3, 71*h*4 and 71*h*5 are increasingly lowered toward the vertical center line V extending through the center C of the drum 22. In FIG. 7(*b*), the horizontal distance A between the leftmost (or uppermost) communication opening 71*h*1 and the rightmost (or lowermost) communication opening 71*h*5 is preferably set be greater than the vertical distance B therebetween. At this point, A:B may be about 7:5.

The water quality detector 58 serves to detect the quality of washing water. The water quality detector 58 is preferably constructed to always detect the water quality regardless of water level in the tub 40. In particular, the water quality detector 58 should be capable of detecting water quality even if the water level in the tub 40 varies because of variation in the quantity of water supplied due to variation in the amount of clothes introduced in the drum 22 or variation in the amount of water absorbed in the clothes. To this end, at least one of the communication opening 71*h*5 may be positioned below the bottom of the tub 40. The water quality detector 58 may include a turbidity sensor 58 for detecting the turbidity of washing water and/or an electrode sensor, which exhibits an output value that varies in accordance with the concentration of electrolyte dissolved in the washing water. Hereinafter, the water quality detector 58 is described as being the turbidity sensor 58.

The chamber 70 may include a drain outlet 71*he* (see FIG. 7(*b*)) communicating with the pump 60. The drain outlet 71*he* is preferably disposed below the turbidity sensor 58. The drain outlet 71*he* is defined by a water discharge connecting pipe 71*b*, and the water discharge connecting pipe 71*b* is connected to a chamber discharge hose 55. Washing water, discharged from the chamber 70, is introduced into the pump housing 62 through the chamber discharge hose 55.

Upon activation of the pump 60, washing water, discharged from the tub 40 through the tub discharge hose 51, and washing water, discharged from the chamber 70 through the chamber discharge hose 55, may be introduced into the pump housing 62 together. The washing water, introduced in the pump housing 62, is discharged to the outside of the washing machine 1 through the water discharge hose 53 as the impeller rotates.

Referring to FIG. 7, the chamber 70 may include a first chamber housing 71 and a second chamber housing 72, combined with the first chamber housing 71. The first chamber housing 71 is provided with the plurality of communication openings 71*h*1, 71*h*2, 71*h*3, 71*h*4 and 71*h*5 and the drain outlet 71*he*, and the second chamber housing 72 is provided with an installation member 71*c* (see FIG. 5) for installation of the turbidity sensor 58. It will be understood that the chamber 70 may be constituted by a single component, differently from this embodiment.

The tub 40 is provided at a lower portion thereof with a chamber mounting member 41 for installation of the chamber 70. The chamber mounting member 41 is provided at the region constituting the lower part of the tub 40, and the lowermost portion of the bottom of the tub 40 is positioned in the chamber mounting member 41. The chamber mounting member 41 is provided with a plurality of mounting holes 41*h*1, 41*h*2, 41*h*3, 41*h*4 and 41*h*5, which are configured in number and position to correspond to those of the plurality of communication openings 71*h*1, 71*h*2, 71*h*3, 71*h*4 and 71*h*5. The tub connecting pipes 71*a*1, 71*a*2, 71*a*3, 71*a*4 and 71*a*5 of the chamber 70 may be fitted in the respective mounting holes 41*h*1, 41*h*2, 41*h*3, 41*h*4 and 41*h*5.

The water discharge connecting pipe 71*b* may be provided with a check valve 80, which is opened by suction force or hydraulic pressure caused by actuation of the pump 60. Upon deactivation of the pump 60, the check valve 80 is closed to prevent washing water from being discharged through the water discharge connecting pipe 71*b*. When the pump 60 is activated during the water discharging procedure, the check valve 80 is opened by hydraulic pressure.

The check valve 80 may be configured to have a pipe shape capable of being fitted in the water discharge connecting pipe 71*b*, and may include an inlet 81 through which washing water is introduced, and an outlet 82 from which the washing water introduced through the inlet 81 is discharged. The check valve 80 is preferably made of a flexible material having elasticity. The check valve 80 may be partially cut at the periphery of the outlet 82. Accordingly, the outlet 82 may be expanded about the cut portion by the hydraulic pressure upon activation of the pump 60, and may be restored to its normal position by its own restoring force upon deactivation of the pump 60.

Figure 8:
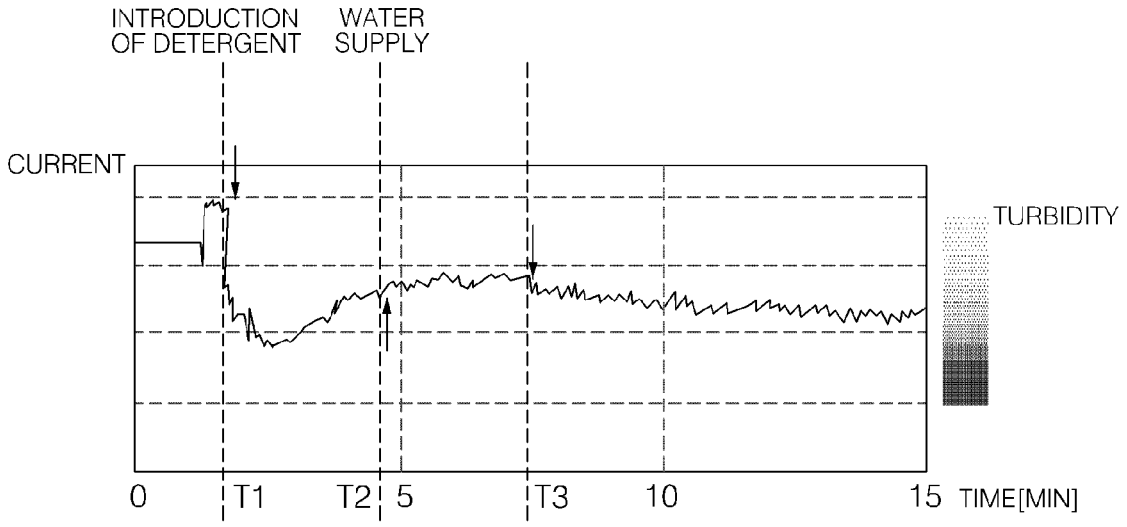
FIG. 8 is a graph showing variation in the output of the turbidity sensor over time.

FIG. 8 is a graph showing variation of in the output of the turbidity sensor to time. Referring to FIG. 8, it is noted that the output current value of the turbidity sensor 58 fluctuates greatly due to causes such as the introduction of detergent T1 and the supply of water T2, but the fluctuation of the output current value is considerably reduced after the point T3, at which a predetermined period of time has elapsed since the supply of water. In particular, after the supply of water, the drum 22 rotates in various patterns, and bubbles generated from the dissolved detergent are present in the tub 40. Nevertheless it is found that output of the turbidity sensor 58 is highly stable.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a tub to contain washing water;

a drum rotatably provided in the tub;

a chamber that communicates with the tub through a plurality of openings in which washing water is introduced from the tub through at least one of the plurality of openings and the introduced washing water is discharged to the tub through at least one of the other openings;

a detector that detects a quality of washing water in the chamber;

a pump that discharges washing water from the tub;

a chamber discharge hose that connects the chamber and the pump;

a tub discharge hose that connects the tub and the pump; and a chamber mount to install the chamber and provided at a lower portion of the tub.

2. The washing machine according to claim 1, wherein the plurality of openings is arranged vertically.

3. The washing machine according to claim 1, wherein the plurality of openings is arranged horizontally.

4. The washing machine according to claim 1, wherein at least one of the plurality of openings is positioned below a bottom surface of the tub.

5. The washing machine according to claim 1, wherein the plurality of openings is arranged vertically and horizontally toward a lowermost opening from an uppermost opening.

6. The washing machine according to claim 5, wherein the plurality of openings is arranged such that, the closer the opening is positioned with respect to a vertical center line of the drum, the lower it is positioned.

7. The washing machine according to claim 1, wherein the detector is positioned to be lower than any of the plurality of openings.

8. The washing machine according to claim 7, wherein the chamber includes a drain outlet that communicates with the pump.

9. The washing machine according to claim 8, wherein the drain outlet is positioned to be lower than the detector.

10. The washing machine according to claim 8, further including a check valve, which closes the drain outlet upon deactivation of the pump and opens the drain outlet upon activation of the pump.

11. The washing machine according to claim 10, wherein the check valve includes an inlet through which washing water is introduced from the chamber, and an outlet through which the washing water introduced through the inlet is discharged and which is expanded by hydraulic pressure upon activation of the pump.

12. The washing machine according to claim 11, wherein the check valve is made of a flexible material having elasticity.

13. The washing machine according to claim 8, wherein the chamber includes first and second chamber housings, which are combined with each other to define a space to receive washing water, in which the first chamber housing is provided with the plurality of openings and the second chamber housing is provided with the installer to install the detector.

14. The washing machine according to claim 1, wherein the detector includes a turbidity sensor.

15. The washing machine according to claim 1, wherein the detector includes an electrode sensor.

16. The washing machine according to claim 1, wherein the detector includes a turbidity sensor and an electrode sensor.

17. The washing machine according to claim 1, wherein a lowermost portion of a bottom of the tub is provided in the chamber mount.

18. The washing machine according to claim 1, wherein the chamber mount is provided with a plurality of mounting holes that corresponds to the plurality of openings, respectively.

19. The washing machine according to claim 1, wherein the chamber includes a plurality of pipes that corresponds to the plurality of openings to connect the tub and the chamber.

* * * * *